US006893110B2

(12) United States Patent
Plymale et al.

(10) Patent No.: US 6,893,110 B2
(45) Date of Patent: May 17, 2005

(54) PRINTER WIPER BLADES BASED ON SURFACE ENERGY

(75) Inventors: James D. Plymale, Brush Prairie, WA (US); Kris M. English, Clackamas, OR (US); Jeffrey K. Pew, Lake Oswego, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 10/420,169

(22) Filed: Apr. 21, 2003

(65) Prior Publication Data

US 2004/0207684 A1 Oct. 21, 2004

(51) Int. Cl.[7] ..... B41J 2/165
(52) U.S. Cl. ..... 347/33
(58) Field of Search ..... 347/22, 33; 106/1.13, 106/1.18, 2, 3, 18.12, 31.27, 31.28

(56) References Cited

U.S. PATENT DOCUMENTS

| | | | | |
|---|---|---|---|---|
| 3,978,705 A | * | 9/1976 | Pearce et al. | 72/325 |
| 5,559,540 A | * | 9/1996 | Burolla | 347/45 |
| 5,898,445 A | | 4/1999 | Becker et al. | |
| 6,145,953 A | | 11/2000 | Medin | |
| 6,176,565 B1 | * | 1/2001 | Yanai et al. | 347/33 |
| 6,290,324 B1 | | 9/2001 | Jackson et al. | |
| 6,312,082 B1 | | 11/2001 | Lund et al. | |
| 6,341,842 B1 | * | 1/2002 | Beach et al. | 347/45 |
| 6,343,857 B1 | | 2/2002 | Cowger | |
| 6,378,981 B1 | | 4/2002 | Wenzel et al. | |
| 6,402,291 B1 | | 6/2002 | Millman et al. | |
| 6,454,383 B2 | | 9/2002 | Lund et al. | |
| 6,454,388 B1 | | 9/2002 | Bretl et al. | |
| 6,460,968 B1 | | 10/2002 | Chee et al. | |

FOREIGN PATENT DOCUMENTS

| | | |
|---|---|---|
| EP | 0942024 A2 | 9/1999 |
| EP | 0942025 A2 | 9/1999 |
| EP | 0942026 A2 | 9/1999 |

* cited by examiner

*Primary Examiner*—Shih-wen Hsieh

(57) ABSTRACT

One aspect of this disclosure relates to a printer apparatus, comprising an orifice plate having a nozzle orifice formed therein. Ink can flow through the nozzle orifice. The orifice plate has an orifice plate surface energy and the ink has an ink surface tension. A wiper blade can be disposed proximate the orifice plate. The wiper has a wiper blade surface energy. The wiper blade surface energy is greater than or equal to the ink surface tension. The ink surface tension is greater than or equal to the orifice plate surface energy.

36 Claims, 12 Drawing Sheets

PRINTER WIPER BLADES BASED ON SURFACE ENERGY

TECHNICAL FIELD

The following subject matter relates to printer pens, and more particularly to printer wiper blades based on surface energy.

BACKGROUND

Printer users expect a certain amount of print quality over the life of their printer. Part of keeping print quality high is maintaining the pen health at a high level. As long as the ink continues its correct flow within the pen, the quality of printing by the printer will be maintained. If, however, for some reason the ink is blocked from flowing through an orifice formed within the pen, then the quality of printing will be diminished. Additionally, the presence of dried ink or other impurities on the orifice plate of the pen may cause the pen to discharge ink in an undesired direction.

SUMMARY

In one aspect, a printer apparatus and associated method is provided, the apparatus comprises an orifice plate having a nozzle orifice formed therein. Ink can flow through the nozzle orifice. The orifice plate has an orifice plate surface energy and the ink has an ink surface tension. A wiper blade can be disposed proximate the orifice plate. The wiper has a wiper blade surface energy. The wiper blade surface energy is greater than or equal to the ink surface tension. The ink surface tension is greater than or equal to the orifice plate surface energy.

DETAILED DESCRIPTION

This disclosure relates to maintaining the print quality of printers in which the pen(s) are maintained in a healthy state. During operation, the pen(s) are used to apply the ink through orifices formed in an orifice plate to the printing surface (e.g., paper). During servicing, ink is extracted out of the pen(s) onto an orifice plate, and the ink is wiped from the surface of the orifice plate.

Figure 1:
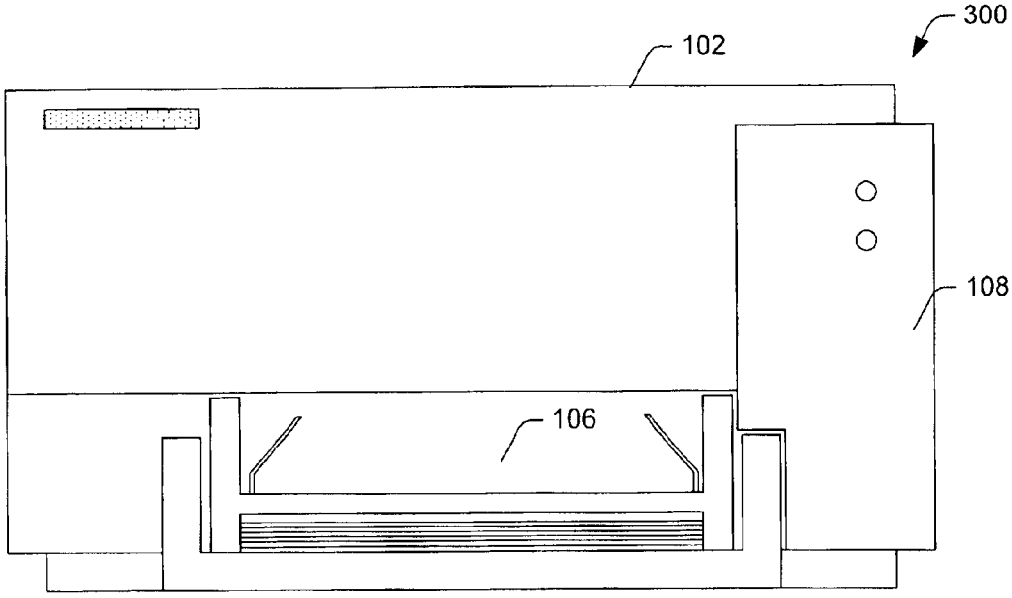
FIG. 1 shows a front view of one embodiment of printer.

FIG. 1 shows one embodiment of a printer 300 such as may contain one or more pens. For instance, certain ink jet printers include four pens, with each pen having a different color. Different embodiments of the printer 300 include inkjet printers, laser printers, bubblejet printers, and laser jet printers. The printer 300 can be, but need not be, representative of inkjet printers manufactured, for example, by the Hewlett-Packard Company. The printer 300 may be capable of printing in black-and-white and/or in color, in which the printer 300 includes one or more pens containing ink of the suitable color(s). The term "printer" or "printing device" refers to a device which ejects ink or other liquid materials onto print media to print on that media. Though an inkjet printer is shown for exemplary purposes, it is noted that aspects of the described embodiments can be implemented in other forms of printing devices that employ inkjet printing elements or other liquid ejecting devices, such as facsimile machines, photocopiers, digital senders, multi-function machines, and the like.

The pen includes a print head or orifice plate that is fabricated using metal-oxide semiconductor (MOS) technology. Different versions of MOS technology may be utilized including PMOS, CMOS, NMOS (each of which depends on the doping of different portions of the device), and JetMOS (which is MOS technology applied to such printers as ink-jet printers, in general). MOS technologies are well known and understood in semiconductor processing, and will not be further detailed herein.

Figure 2:
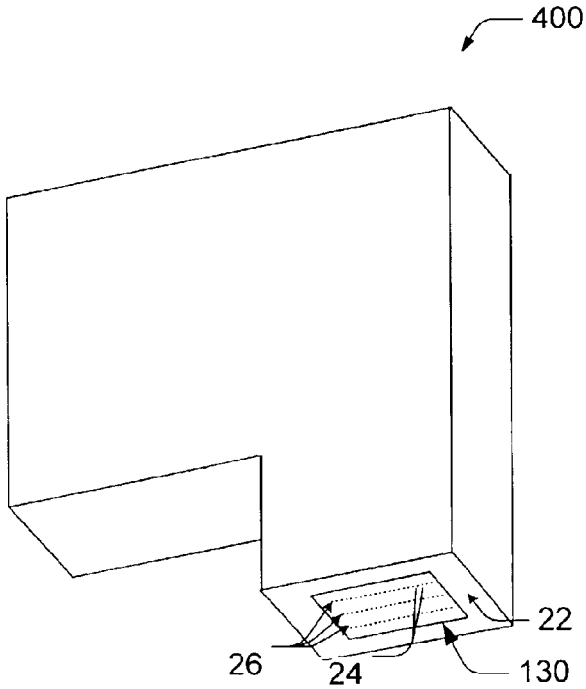
FIG. 2 shows a perspective view of one embodiment of a pen such as would be used in the printer of FIG. 1.
Figure 3:
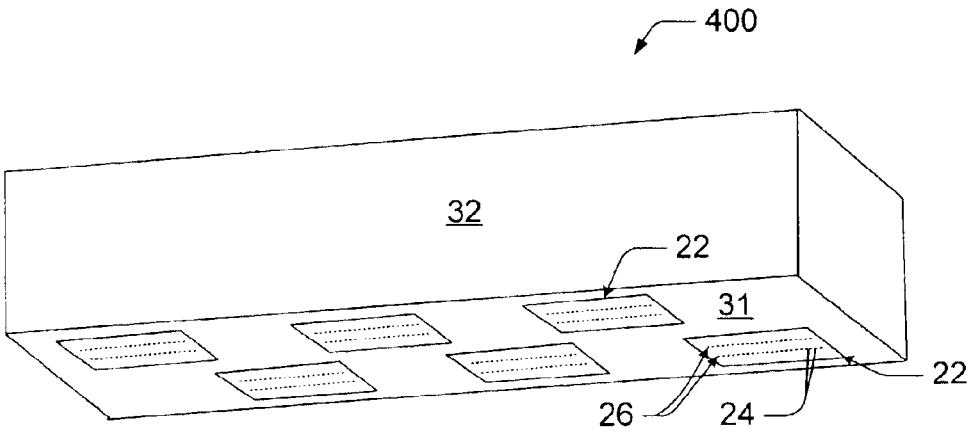
FIG. 3 shows a perspective view of another embodiment of a pen such as would be used in the printer of FIG. 1.

The printer 300 includes a housing 102, a paper input (not shown), a paper output 106, a controller 108, and a carriage (not shown, but located within the housing 102). The carriage is configured to securely carry one or more of the pens 400, different embodiments of which are shown in FIGS. 2 and 3. The pen(s) 400 in the printer 300 may contain ink of different colors such as black, magenta, yellow, or cyan. The color of the ink corresponds to the colors in which the printer 300 can print. Often, the pen 400 is located in a carriage (not shown) in the printer. The pen 400 can be electrically coupled with, and controlled by, a controller 108 as shown in FIG. 1 to selectively eject ink in the desired amounts and at the desired angles to form a desired image.

The pen 400 has one or more print head(s) 22 each of which includes one or more orifice(s) 24 arranged in one or more generally linear orifice array(s) 26. Ink can be selectively ejected from individual orifices 24 to create the desired image on print media such as paper, transparencies, etc. In various suitable embodiments, the pen 400 and/or the print media can be moved relative to one another to form portions of the desired image. The pen 400 can contain an internal ink source and/or be connected to an external ink source for supplying ink to the various nozzle orifices 24.

The pen 400 shown in FIG. 2 can be configured to be disposable and thus be replaced during the useful life of the printer. Alternatively or additionally, the pen can be designed to last the life of the printer. FIG. 2 shows a single pen with a print head 22 that would fit within the printer in FIG. 1. FIG. 3 shows a pen 400 that has multiple print heads 22 that would fit into the printer shown in FIG. 1. Individual print heads 22, in the FIG. 3 embodiment, comprise two generally linear orifice arrays 26, each of which has multiple orifices 24. The print heads 22 are positioned on a first support structure 31 of the pen 400. The first support structure 31 is oriented generally orthogonal to a second support structure 32.

Figure 4:
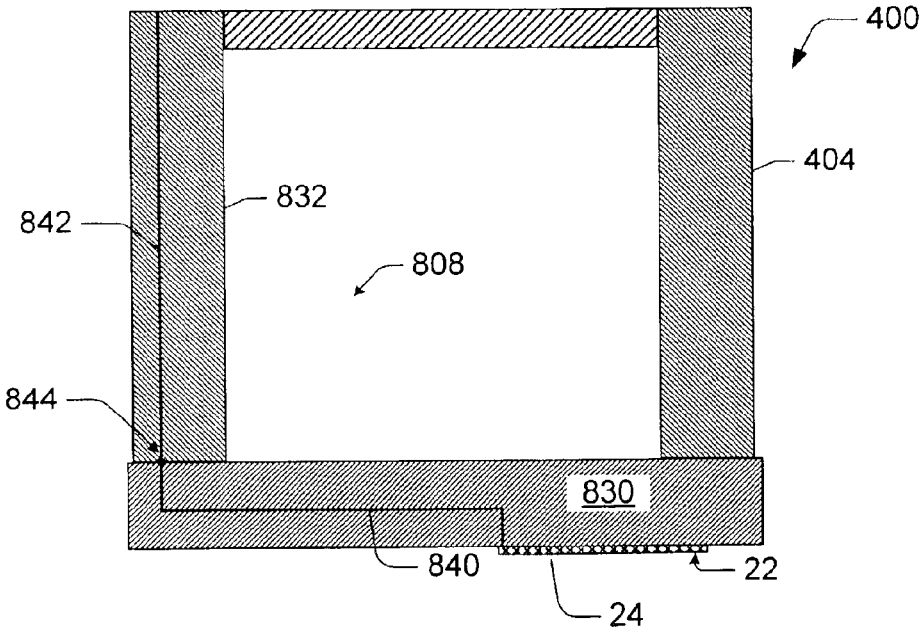
FIG. 4 shows a cross-sectional view of the pen shown in FIG. 3.

FIG. 4 shows a cross-sectional view through pen 400 as indicated in FIG. 2 or 3. The pen 400 includes the first support structure 830 supporting the print heads 22, and a first conductor 840. The pen 400 also comprises the second support structure 832 supporting a second conductor 842. The support structures (830 and 832) can support a respective conductor in various suitable configurations including, but not limited to, portions and/or an entirety of the conductor being positioned on or within the support structure. In this embodiment, the first conductor 840 is electrically coupled to the print head 22. The first conductor is also electrically coupled to the second conductor 842 at electrical interconnect 844.

The first and second support structures (830 and 832) can be comprised of any suitable material or materials. The first support structure 830 can comprise the same materials as the second support structure or they can be of different materials. For example, in one embodiment, the first support structure 830 is comprised of ceramic, such as a multilayer ceramic, while the second support structure 832 may include a polymer. Suitable support structures can be formed from a single material or from multiple materials and can be formed in any suitable way such as injection molding or formation of a composite material.

Each pen 400 includes a pen housing 404 and an integrated circuit such as the print head or IC 22. The print head is typically produced using MOS technology. The pen housing 404 contains one (or more) ink reservoir 808 that contains ink of a color that corresponds to the color of the pen. The print head or IC 22 includes a plurality of orifices 24 through which ink can controllably flow. The orifices 24 are in liquid communication with the ink contained within the ink reservoir. One or more orifice resistors (not shown) are arranged about the orifice 24 and control the flow of ink through the orifice. The bore geometry determines the rate at which ink flows through prescribed ones of the orifices, and also the angle at which the ink exits the orifice. The state of different electrical components in the integrated circuit determines the electric/voltage applied to the orifice resistors. As with ICs applied to technologies other than printers, ICs that are applied to printers have generally become smaller to fit in more confined spaces and with a greater density of electronic circuitry to perform more sophisticated functions.

Cleaning Mechanism

The pen 400 in the printer 300 is serviced to ensure that it continues to print properly. Servicing the pen 400 can be triggered by some usage-based algorithm (e.g., the pen has spit so many drops, or the pen has been capped or un-capped for so much time), or alternatively by some external request (e.g., a user request to service the pen, or a request received from a computer coupled to the printer). Certain aspects of servicing involve two mechanisms—"spitting" and "wiping". All servicing events do not have to trigger wiping of the pen 400. After the pen spits ink, ink is drawn out of at least some of the orifices by a portion of the wiper blade breaking a meniscus formed over the ink within the nozzle orifice in the orifice plate. The ink after being drawn out fills a capillary channel formed between the wiper blade and the orifice plate.

The ink is subsequently wiped from the orifice plate using another portion of the movable wiper blade. After ink is wiped from the pen, the wiper blade is usually also cleansed using a scraper. The scraper is typically a passive plastic bar (or other shape) which is configured to come in contact with the wiper blade. The wiper contacts the scraper, and the scraper scrapes the residue ink off the wiper.

It is desired to maintain the health of pens to provide proper printer operation. In healthy pens, the nozzle orifices of the pen are present, meaning that the nozzle orifices contain ink and the pen can fire the ink through the nozzle orifices on to the paper. Each nozzle orifice is associated with a particular nozzle resistor that controls the firing of that particular nozzle orifice. The nozzle resistor which does the firing acts to heat up, and therefore fire the ink. When a pen is healthy, ink exits the nozzle orifice in the desired drop size and drop direction.

Nozzle orifices can, however, become partially or fully plugged which acts to diminish the health of the pens. The plugs can be characterized as either hard or soft. Soft plugs are formed from things which have accumulated into the nozzle orifice but have not hardened. The soft plugs generally can be fired out (cleaned out) using the spitting and wiping operation. If an orifice plate has soft plugs, then typically the nozzle orifice can be recovered by firing lots of drops and doing a lot of wiping. Soft plugs can be formed including ink or ink goo.

A hard plug is a plug in which the firing mechanism (e.g., resistor) is otherwise healthy, but the nozzle orifice remains permanently clogged. The hard plug is formed from a material which cannot be worked loose. If a nozzle orifice having a hard plug is continued to be used, eventually the resistor of the firing mechanism will fail.

Figure 5:
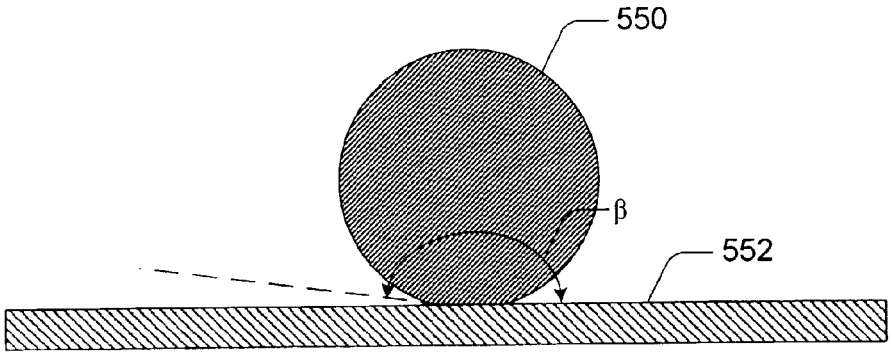
FIG. 5 shows a view of a liquid having a first surface tension contacting a plate.
Figure 6:
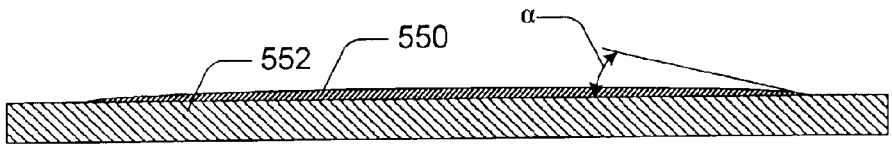
FIG. 6 shows a view of a liquid having a second surface tension contacting a plate.

Wettability is a concept that is associated with the cleaning mechanism of the present disclosure. Wettability may be equated to the tendency for a liquid to wet a particular surface of a material. Contact angle of a specific liquid to a specific contacting surface of a solid 552 provides an indication of how well the liquid will wet the solid. For example, FIGS. 5 and 6 illustrate two embodiments of a liquid 550 contacting the solid 552. In FIG. 5, the liquid 550 is not wettable to the solid 552 due to the surface tension of the liquid 550 being significantly higher than the critical surface tension of wetting of the solid 552. In FIG. 6, the liquid 550 is wettable to a contacting surface of the solid 552 due to the critical surface tension of wetting of the solid 552 being higher than the surface tension of the liquid. The wettability of the liquid 550 to the solid 552 is considerably higher in FIG. 6 than in FIG. 5. As such, the liquid 550 is more likely to bead up on the contacting surface of the solid 552 in the configuration shown in FIG. 5 than the configuration shown in FIG. 6.

The wettability of a liquid 550 for the contacting surface of a solid is related to the contact angle that the liquid forms with the contacting surface of the solid. If the contact angle is less than some angle such as 90 degrees, the liquid is said to wet the solid. However, if the contact angle is greater than 90 degrees, the liquid is said not to wet the solid. For example, in FIG. 5, a relatively high contact angle $\beta$ (e.g., greater than 90 degrees) between the contacting surface of the solid 552 and the liquid 550 indicates that the liquid 550 is not wettable to the contacting surface of the solid 552 and is likely to bead up on the contacting surface. In FIG. 6, a relatively shallow contact angle α (e.g., less than 90 degrees and approaching 0 degrees) indicates that the liquid 550 is wettable to the contacting surface of the solid 552 and is not likely to bead up on the contacting surface of the solid.

In this disclosure, using a contact angle of 90 degrees to differentiate between a liquid that wets a solid from a liquid that does not wet a solid is illustrative in nature, and is not limiting in scope. Different contact angles may be suited to differentiate different liquids wetting different solids. As such, in certain applications the contact angle that differentiates between a liquid being wettable and not wettable can vary from the 90 degree limit. However, greater contact angles generally result in less tendency for a liquid to wet a solid.

The effect of contact angle on wettability equates to placing a liquid such as water on Teflon® (a trademark of the E.I. Nemours Dupont and Company) or putting the water on glass. On Teflon, water and certain inks both bead up because of their relatively high surface tensions, and therefore their inability to wet the contact surface of the solid. Consequently, the contact surface is not very wettable in that Teflon surface energy is much lower than water surface tension. Conversely, if water or certain types of ink are placed on glass, the water will not bead up because water wants to wet the contact surface. Glass surface energy is higher than water surface tension.

These wettability (and contact angle) concepts of specific liquids to contacting surfaces of solids applies to ink (a liquid) and the orifice plate and the wiper (which are two respective contacting surfaces) in certain aspects of the present disclosure. Certain embodiments of the cleaning mechanism are configured where the three part cleaning system (ink, wiper blade, and orifice plate) are provided to have the ink (liquid) wettable to the wiper, while the ink is not wettable to the orifice plate. In these embodiments, the wettability of the ink to the wiper will assist in pulling the ink out of the nozzle orifice(s) once the meniscus is broken by contact with the wiper. This ink will assist the wiper in cleaning other nozzle orifices that are downstream of the nozzle orifice(s) from which additional ink is being drawn out of, and eventually move the ink away from the nozzle orifice(s). In addition, the ink will not have a propensity to propagate across the orifice plate. After being wiped by the wipers included in the cleaning mechanism, the ink immediately surrounding the orifice is either pulled back into the orifice (at least partially because the surface tension of the ink exceeds the surface energy of the orifice plate, and partially because the capillary pressure of the nozzle bore), or is beaded up on the surface of the orifice plate at a location distant from the nozzle orifice.

Surface tension of the ink, and surface energy of the wiper and the orifice plate, are two mechanisms used by the cleaning mechanism. Surface energy is the level of energy on the surface of a solid. For a liquid to wet a solid, the surface energy of the solid must be high enough to overcome the surface tension of a liquid. Surface tension is the tendency of a liquid to gather itself into a shape approximating a ball. Contact angles of a liquid on a solid are a method to visualize and measure surface energy. A higher (e.g., greater than 90 degrees) contact angle (the tangency angle of a water droplet on a surface) is a result of decreased wettability. A lower (e.g., less than 90 degrees) contact angle is a result of increased wettability. The closer the contact angle gets to 0 degrees as illustrated in FIG. 6 compared to FIG. 5, the less likely that the liquid (i.e., ink) droplet is to bead up on the surface The nozzle orifices are configured to be arranged in rows, so as the wiper travels along the row. Each color is located in the pen in columns. So, with multiple colors, the pen has multiple columns.

Figure 8:
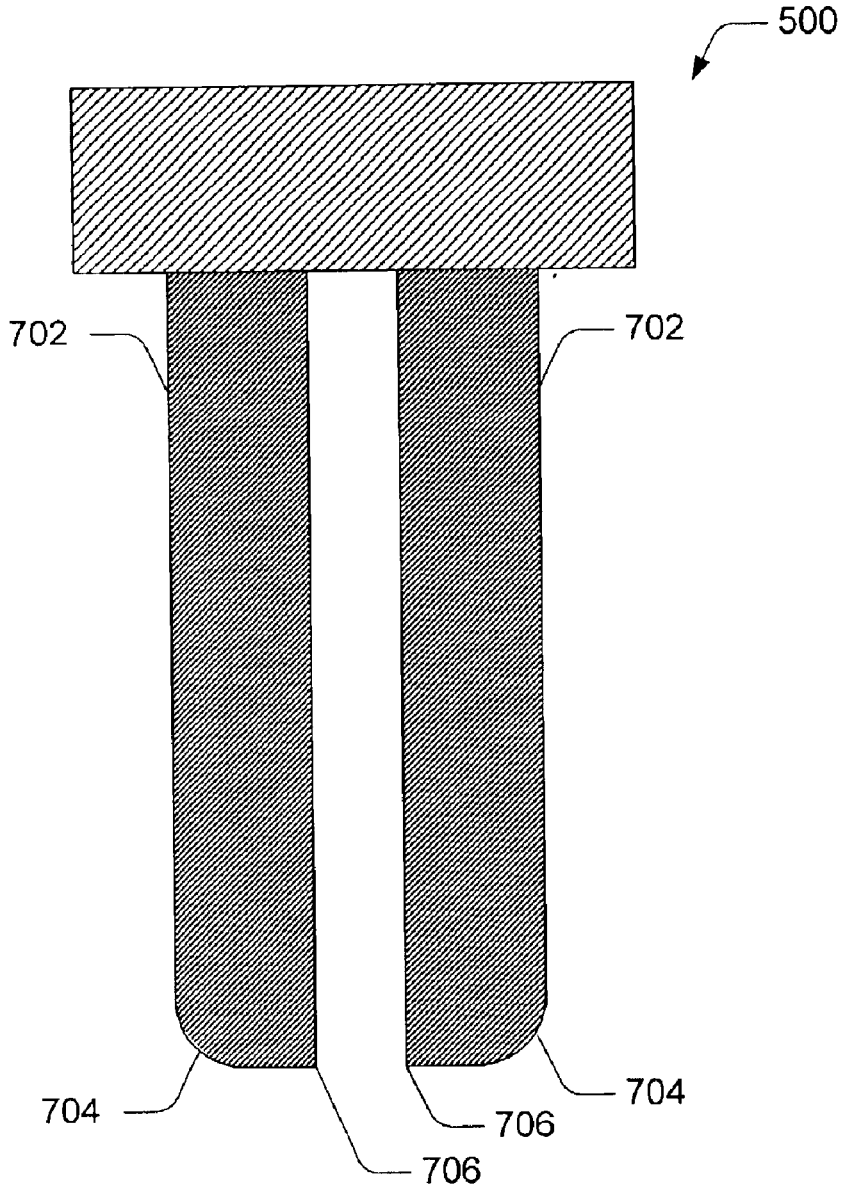
FIG. 8 shows a side view of one embodiment of a cleaning mechanism having a plurality of wiper blades that is used during a servicing operation.
Figure 9:
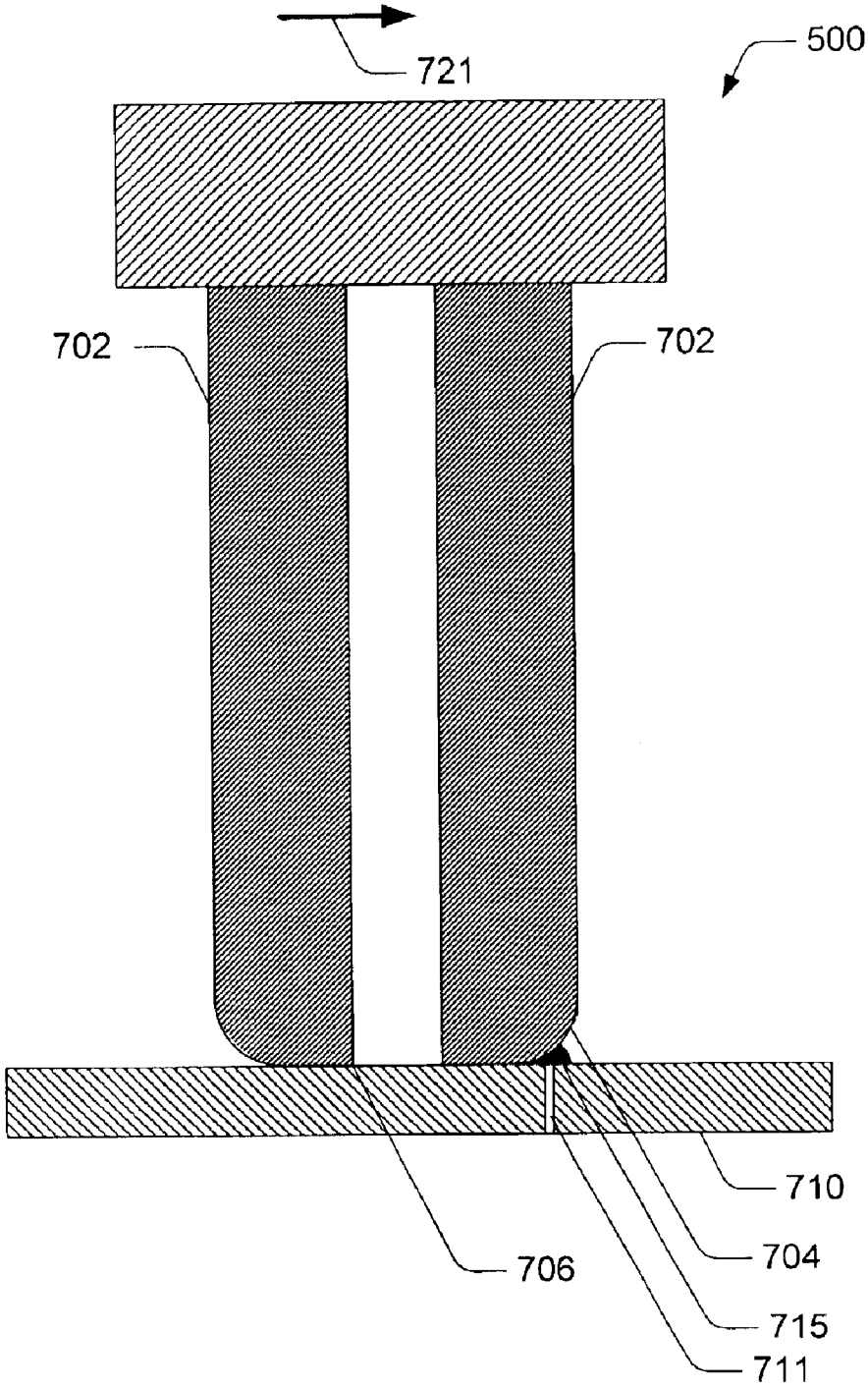
FIG. 9 shows the cleaning mechanism of FIG. 8 as traveling across an orifice plate in a first direction.
Figure 10:
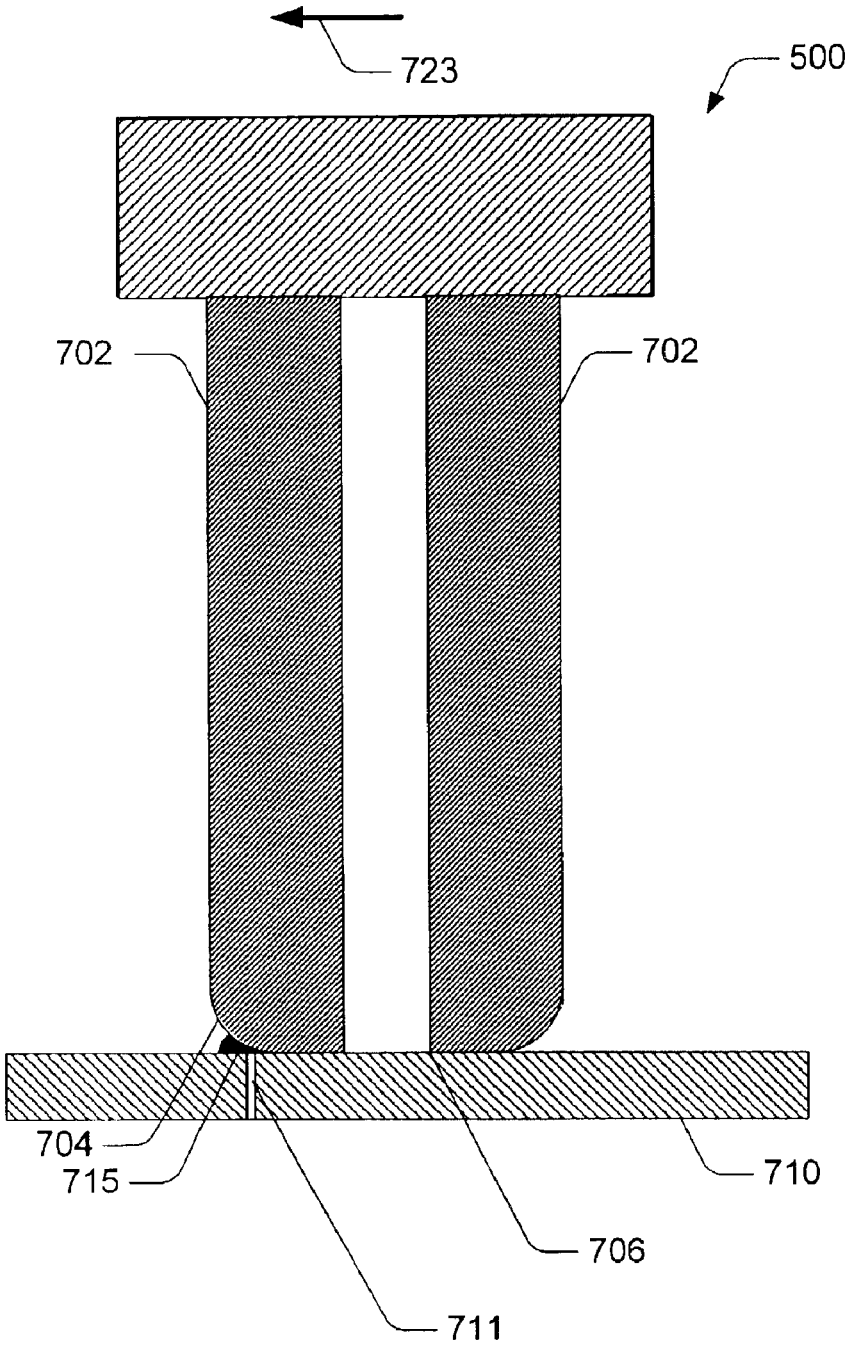
FIG. 10 shows the cleaning mechanism of FIG. 8 as traveling across an orifice plate in a second direction, the second direction being substantially opposed to the first direction illustrated in FIG. 9.

One embodiment of a cleaning mechanism is now described. The cleaning mechanism 500 includes two wiper blades 702 as illustrated in FIGS. 8, 9, and 10. To clean the orifice plate, the cleaning mechanism 500 (which includes the wiper blades 702 that is positioned proximate the orifice plate) acts to draw a wiping surface formed by the wiper blade across the surface of the orifice plate 710. Depending upon the configuration and material of the wiper blade, the orifice plate 710, and the ink, the wiper blade effectively wipes ink from the surface of the orifice plate, and can even draw ink and other impurities from within the nozzle orifice 711 formed in the orifice plate (as shown in FIG. 9 below). In one embodiment of orifice plate cleaning, during a first wipe, the cleaning mechanism 500 draws the wiper blade in a first direction as indicated by arrow 721 in FIG. 9 across the orifice. During a second wipe, the cleaning mechanism draws the wiper blade in a second direction 723 in FIG. 10, which may be substantially opposed to the first direction 721, across the orifice plate.

Servicing the orifice plate 710 often includes a bi-directional wipe involving two wiper blades 702. The tip of each wiper blade 702 is formed so that one edge is rounded and the other edge is squared-off as indicated in FIG. 8. During the bi-directional wipe, the cleaning mechanism 500 travels in the direction indicated by the arrow 721 in FIG. 9, then returns in the direction indicated by the arrow 723 in FIG. 10. To produce this bi-directional wipe, the wiper blades 702 of the cleaning mechanism 500 is configured, with a substantial mirror configuration about a vertical axis, to perform similar wiping operations in both directions indicated by the arrows 721 and 723 respectively in FIGS. 9 and 10. For example, the cleaning mechanism 500 associated with the pen includes two wiper blades 702 that are substantially mirror images of each other.

As such, this portion of the disclosure describes the structure of the cleaning mechanism relating to the wipe in the direction indicated by arrow 721 as shown in FIG. 9. The similar structure in the opposite one of the pair of the wiper blades 702 will apply to the wipe in the direction indicated by the arrow 723 as shown in FIG. 10. The two wiper blades 702 are characterized as a leading wiper blade and a trailing wiper blade (depending on which direction the cleaning mechanism is traveling as indicted by respective arrows 721 and 723 in FIGS. 9 and 10) are spaced side by side, and are separated in one embodiment by 6–8 mm. During operation, there are two edges that are of particular concern during the wiping operation, the rounded surface 704 of the leading wiper blade 702 and the squared-off surface 706 of the trailing wiper blade 702. The squared-off surface 706 of the pair of wiper blades 702 face each other. The rounded surfaces of the pair of wiper blades 702 face outwardly from each other. As the orifice plate is wiped, the leading wiper blade draws ink from the nozzle orifices and the trailing wiper blade (which trails the leading wiper blade by the 6–8 mm spacing) squeegees that ink off the surface of the orifice plate 710. A force is applied to the rounded surface of the leading wiper blade against the orifice plate to maintain contact there between, and to create the capillary channel 715. A force is also applied to the squared-off surface 706 of the trailing wiper blade and the orifice plate 710 to provide the squeegee effect.

In certain embodiments, the capillary channel 715 is formed by the rounded surface of the wiper blade and the orifice plate, and is configured to draw the ink out of the pen. The physical presence of the rounded surface 704, the pressure created within the capillary channel 715, and the presence of the ink contained within the capillary channel 715 breaks the meniscus and acts to pull the ink out of the nozzle orifices 711. The ink that is drawn out of the nozzle orifice 711 (both in front of and behind the rounded surface 704) fills the capillary channel. The ink floods into the capillary channel by being "wicked" out of the nozzle orifice into the capillary channel 715 between the wiper blade 702 and the orifice plate 710.

The mechanisms that draw ink out of the nozzle orifices 711 in the pen involve consideration of how the meniscus is formed, and broken, in the nozzle orifice 711 of the pen. The rounded surface 704 of the wiper forms the capillary channel 715 with the orifice plate 710. If the pressure created by the pressure and/or presence of ink within the capillary channel 715, and/or the physical contact of the wiper blade 702, is sufficiently large to break the meniscus in the nozzle orifice, then ink is drawn out by the pressure created within the capillary channel 715 to fill the capillary channel.

Partially due to the rounded shape of the rounded surface 704, the leading wiper blade 702 passes over some of the flooded ink that is drawn out of the nozzle orifice 711 into the capillary channel 715. Some ink therefore exists in, or "floods", the surface of the orifice plate 710 in that region between the leading wiper blade and the trailing wiper blade. As the trailing wiper blade (which is formed with a squared-off leading surface, and thereby forms no capillary channel) travels along the orifice plate, the squared-off surface acts to squeegee the ink off the orifice plate.

When the direction of travel of the cleaning mechanism 500 is reversed as shown by the arrow 723 in FIG. 10, a similar process is performed as the cleaning mechanism travels from right to left as indicated by arrow 723 in FIG. 10. In FIG. 10, the leading wiper blade 702 is the left wiper blade while the trailing wiper blade 702 is the right wiper blade. In FIG. 10, the capillary channel 715 exists adjacent the rounded surface 704 on the leading (left) wiper blade 702. The squared-off surface 706 that acts as the squeegee is on the right wiper blade in FIG. 10.

The wiper blades can be formed from a variety of materials. In one embodiment, the wiper blades 702 are formed of a deformable material, such as a type of rubber. The rounded leading surface of the leading wiper blade deforms and bends over when the wiper blade contacts the orifice plate 710. Since the wiper blade 702 of the leading blade and the orifice plate 710 together create the capillary channel, any deflection or deformation of the leading wiper blade 702 will provide a modified cross-section configuration of the capillary channel 715. As such, any consideration of the configuration of the capillary channel should consider such deflection or deformation of the leading wiper blade. As the wiper blade comes in contact with the orifice plate, the wiper and/or the pressure provided in the capillary channel breaks the meniscus and draws ink out of the nozzle orifices. The ink that is drawn out of the nozzle orifice 710 is useful in servicing downstream nozzle orifices.

Cleaning of a pen relies on two aspects, wicking and wiping. During wicking, capillary forces tend to pull ink out of the nozzle orifices. This ink is often used to service downstream nozzle orifices. During wiping, any remaining ink on the pen surface is removed.

Certain aspects of this disclosure, as such, relate to improving the cleaning of printer pens by providing the surface energy of the orifice plate 710 and/or the wiper blade 702 in combination with the surface tension of the ink. In one aspect, this enhances the operation of the wiper blade by increasing the wettability of the ink to the wiper blade while decreasing the wettability of the ink to the orifice plate 710. This enhancement improves the cleaning effect of the wiper blade, and can improve the pen life, pen health, and general pen operation of those pens that include wipers. Surface energy modifications to the wiper blade 702 and the orifice plate 710 can be accomplished by modifications including changes in design, materials, surface treatments, and the like. In one embodiment, the surface energy of the wiper blade should exceed the surface tension of the ink by a suitable first amount to increase the wettability of the ink on the wiper blade. Additionally, the surface tension of the ink should also exceed the surface energy of the surface of the orifice plate by a suitable second amount to decrease the wettability of the ink on the orifice plate.

The surface of the wiper blades can be altered relative to the ink to provide enhanced cleaning action by changing the angle of the wiper blades. Changing the angle of the wiper blade relative to the surface plate alters the configuration of the capillary channel (and thereby affect the capillary action) of the ink that is contained within. This does not change the surface energy of the wiper In one embodiment of the cleaning mechanism, the wiper blade(s) can be formed including Teflon, a relatively low surface energy material. During operation, the Teflon wiper likely transfers Teflon from the surface of the wiper blade to the surface of the orifice plate. Teflon can be transferred in this manner, by filling in the gaps in a contacting surface of some other solid by physical contact. The surface energy of orifice plate 710 of the pen will likely be reduced by using a Teflon wiper blade. As such, using Teflon as the wiper blade tends to reduce the wettability of the ink to the wiper blade, and also the wettability of the ink to the orifice plate 710 (since the orifice plate is contacted by the wiper blade).

If the wiper blade 702 is formed with copper (a relatively high surface energy material) instead of Teflon, for example, an increased ink flow from the nozzle bore results. Once the meniscus is broken to produce a capillary channel 715, a Teflon wiper blade doesn't attract ink, whereas the copper wiper does attract ink. The use of both materials in the wiper blades, in fact, can have benefits. Using a higher surface energy wiper (such as including copper) generally results in a more liquid system than when a lower surface energy (e.g., Teflon) wiper is used. Using the low surface energy wiper (e.g., including Teflon) changed the property of the pen and kept ink from building up on the pen, similar to as the easy-clean properties of a Teflon cooking pan.

In certain embodiments, the cleaning mechanism utilizes the wettability force from the surface tension of the ink, and the surface energies of the wiper blade material and the orifice plate material, to help draw the ink from the orifice plate to the wiper blade. The capillary forces applied by the wicking action of the capillary channel are combined with the wiping action to produce an effective cleaning action.

Figure 7:
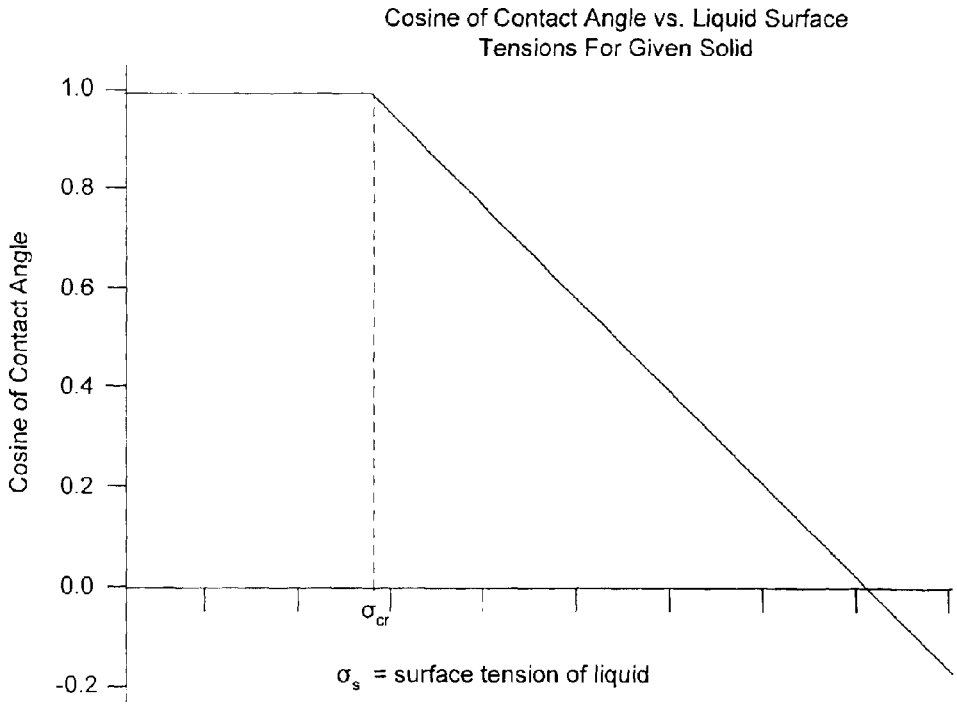
FIG. 7 shows a plot of a cosine of contact angle vs. liquid surface tensions for a given solid.

One aspect of this disclosure relates to how wettable the liquid (i.e., the ink) is on the orifice plate, and then how wettable the ink is on the wiper blade. For any material, a solid will have a critical surface tension of wetting. The critical surface tension of wetting is the surface tension below which the liquid fully wets that solid. As a general rule, if the surface tension of the ink is at least 10 dynes/cm lower than the surface energy of the solid, then the liquid will want to wet the solid. FIG. 7 shows a plot of one embodiment of contact angle as a function of liquid surface tension for one particular solid. Notice the decrease in the cosine of the contact angle after the critical surface tension is reached.

In one aspect of this disclosure, the ink should wet the wiper blades 702 but bead up on the orifice plate 710. The rounded surface of the leading wiper blade 702 will break the meniscus of the ink, and the resulting capillary action will draw the ink on to the surface of the orifice plate. The speed of the wiper blade traveling across the orifice plate can be selected to break the meniscus and service the nozzle orifices of the particular column, and also the downstream nozzle orifices.

Figure 11:
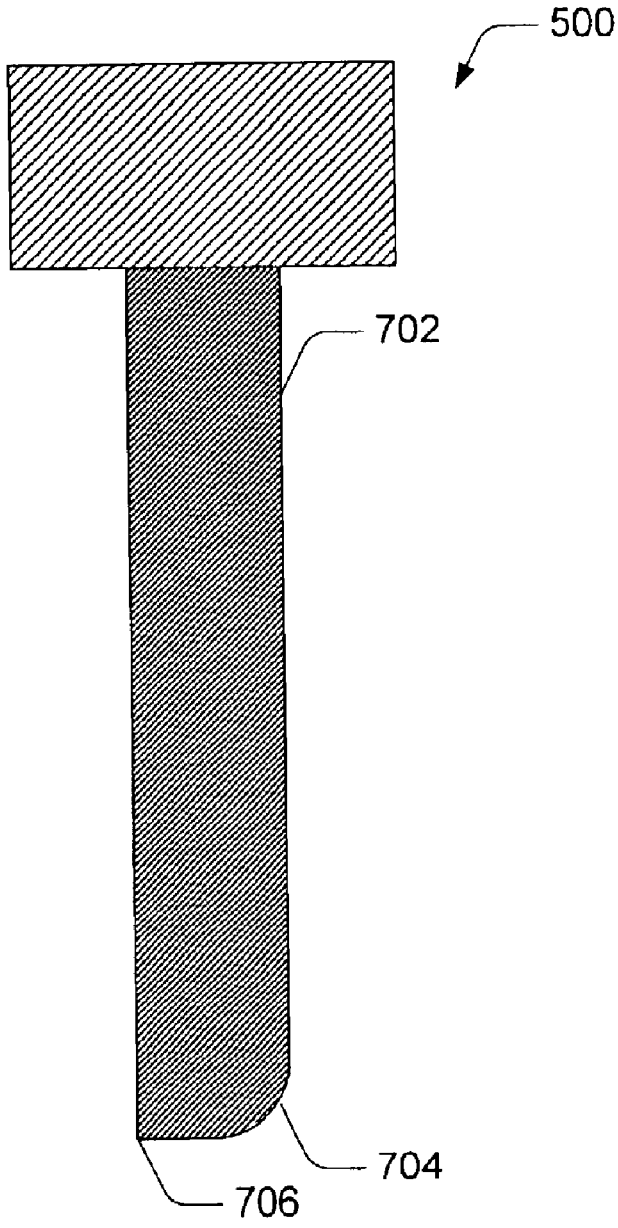
FIG. 11 shows a side view of one embodiment of a cleaning mechanism having a single wiper blade that is used during a servicing operation.

There are different ways to look at how wettability concepts might provide an effective cleaning mechanism. A wettability parameter could present the use of a cleaning mechanism having one wiper blade as shown in FIG. 11. This cleaning mechanism configuration will be effective since one wiper blade configured to be highly wettable compared to the orifice plate will perform as well as two wiper blades in which each one of the two wiper blades are not highly wettable. Additionally, cleaning mechanisms having one, two, or more wiper blades can be designed to function effectively while traveling at an increased speed across the orifice plate since the ink is increasingly attracted to the wipe blade. This increased wiper blade speed would reduce servicing time.

A cleaning mechanism with highly wettable (and wetted) wiper blades and a non-wettable orifice plate might function better than in existing systems. The wiper blades might have a tendency to pull the ink away from the orifice plate, and the low surface energy orifice plate would bead up any ink that was not either wiped off or pulled back into the nozzle by the capillary pressure of the nozzle. Difficulties can arise when ink collects adjacent the nozzle orifices (as a result of shooting ink through pools and/or plugs associated with the ink). Removing the ink more effectively might also reduce the number of times that servicing is performed.

This disclosure provides several potential advantages. Initially, the number of servicing events can be reduced over the life of the pen because the ink and other debris in the area immediately surrounding the nozzle orifices is reduced. The drop directionality of the orifice plate in the pen is improved since ink puddling and/or ink pooling near the nozzle orifice is reduced. The number of soft or hard plugs (resulting primarily from dried ink) is also reduced because the area immediately surrounding the nozzle orifices is kept cleaner from ink and/or other debris.

Much of the increased cleaning action of the wiper blades results from more effectively balancing the surface tension of the ink with the surface energies of the orifice plate and the wiper blade, which in turn acts to pull more ink out of the nozzle orifice. This increased amount of ink can also be used to clean the downstream nozzle orifices 711 in the orifice plate 710. The cleaning mechanism that is designed according to this disclosure leaves the pen cleaner for a longer time. As such, pens can be designed to have longer lifespans.

The enhanced efficiency of removal of cleaning ink from the orifice plate (which also limits the ink on the regions of the orifice plate adjacent to the nozzle orifices) reduces the need for external cleaning solvent to be applied to the pens. Examples of cleaning solvents that are used include polyethylene glycol (PEG) and glycerol which are intended to maintain the pen life in a healthy state.

The cleaning assemblies utilizing the wettability parameter increase wiping efficiency by allowing faster wiping speeds. Faster wiping speeds are allowed since the wiper blade performs a more thorough cleaning action by wicking more ink out of the nozzle orifices and displacing the ink far from the nozzle orifice.

The orifice plate is described in certain embodiments as displaying low wettability, wherein a considerable bore length of the nozzle orifices should be highly wettable. Making the bore highly wettable allows ink to wet the "chimney stack" forming the nozzle orifices that are located above the resistor. Making the nozzle orifices non-wettable (such as by adding fluorine or roughening the surface of the nozzle orifices) is known to affect wettability of certain liquids for the nozzle orifices made from certain solids. In one embodiment, only the top few microns of the orifice plate including the nozzle orifice should be fluorinated (and should not be wettable), so the ink beads up on an exposed surface of the orifice plate, and the rest of the nozzle orifice formed within the orifice plate should be highly wettable to allow the passage of ink.

To accomplish wettability in certain surfaces, the surface to be made less wettable is coated or polished (e.g., laser treating or adding fluorinated molecules). There are many additional chemical techniques that could be adopted for that purpose, and are known to diminish wettability of a surface in general. Applying such chemical techniques to portions of the orifice plate 710 is intended to remain within the intended scope of the disclosure. Molecules can be added to the surface such that the effective contact angle, or wettability parameter, is changed. Also, if the surface of the orifice plate is made smoother, it is more likely to bead up liquids located there upon (including ink).

The following demonstrates particular embodiments of current cleaning mechanism including the ink, the wiper blade, and the orifice plate. Historically, for current pens used in many printers, inks are maintained at about 35 dynes/cm range while the orifice plate (using a surface treatment manufacturing process) is about 70 dynes/cm. As such, ink is very wettable to current orifice plates. Current wiper blades have a surface energy of about 35 dynes/cm. The ink in current designs is therefore more attracted to the orifice plate than the wiper blade.

Using comparable surface tension of the ink and the surface energy of the orifice plate, several embodiments of the present disclosure use a wiper blade having an increased surface energy to improve overall cleaning effectiveness. One embodiment would use a Styrene-Butadiene Rubber (SBR rubber) to form the wiper blade(s) 702 which has a surface energy of about 48 dynes/cm. Additionally, copper, which has a surface energy of about 1100 dynes/cm, could be included wiper blade 702. Tests were run to compare the effects of surface energy of the wiper blade on the effectiveness of the cleaning mechanism 500. The results indicated that the surface energy value was influential, and affected the cleaning characteristics of the cleaning mechanism. Considering the disclosed design that the surface energy of the wiper blade 702 exceeds the surface tension of the ink, there are a wide variety of materials that can be selected from which to form the wiper blade.

Figure 12:
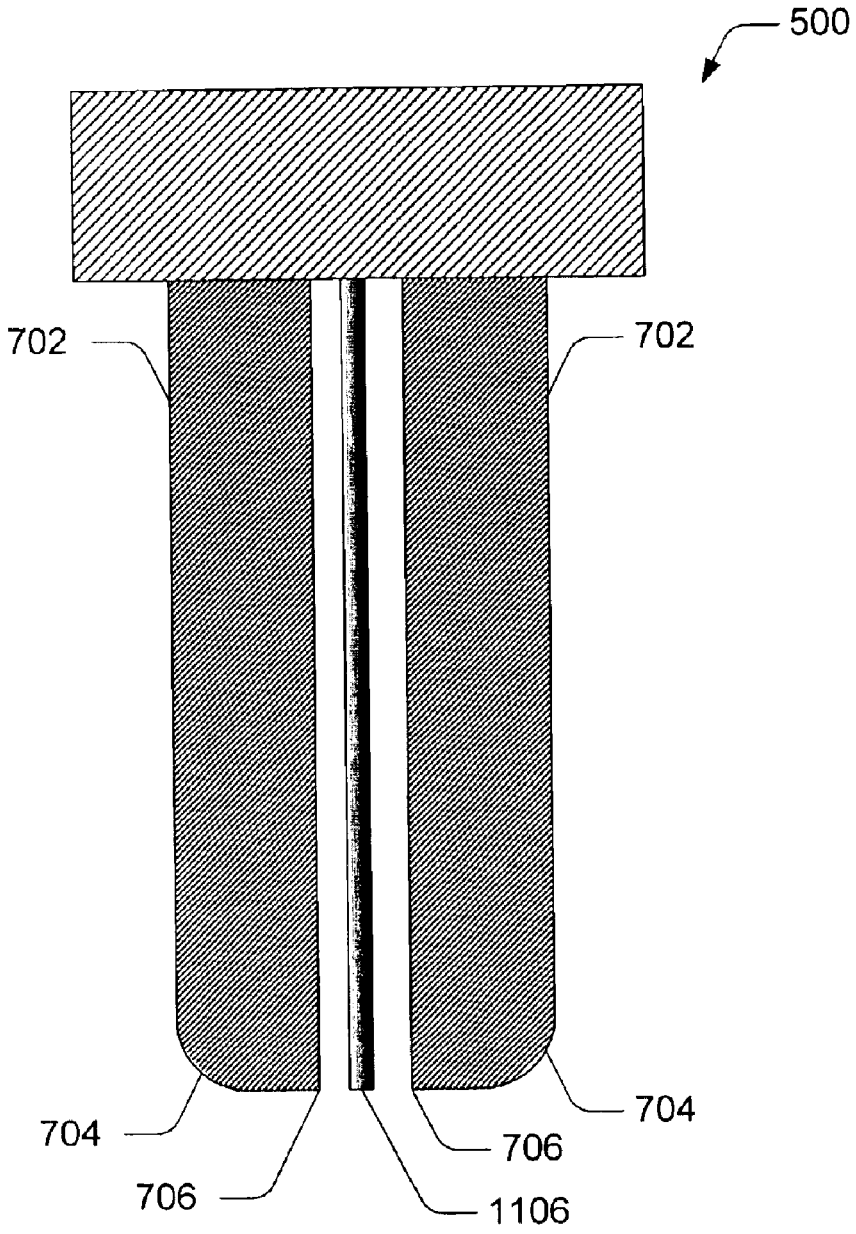
FIG. 12 shows a side view of another embodiment of cleaning mechanism having multiple wiper blades.
Figure 13:
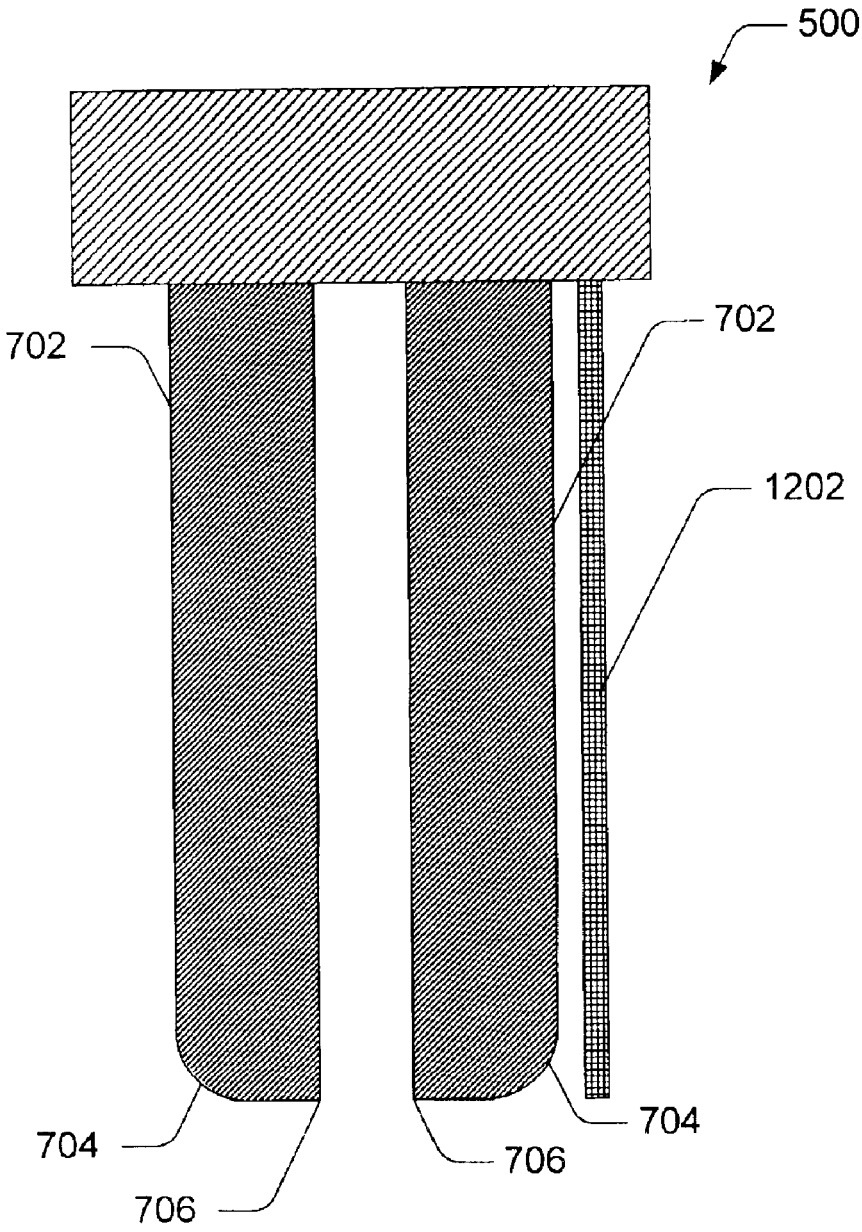
FIG. 13 shows a side view of yet another embodiment of cleaning mechanism having multiple wiper blades.
Figure 14:
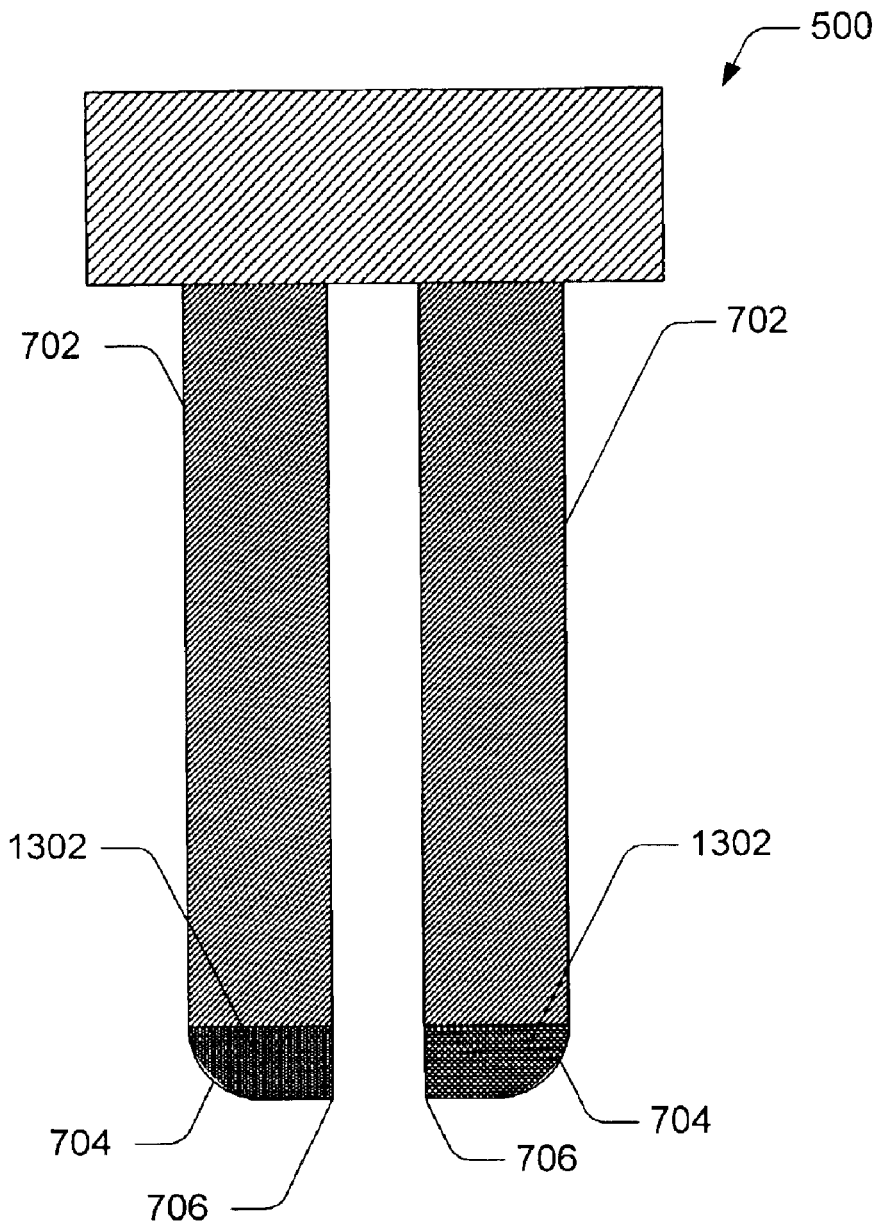
FIG. 14 shows a side view of still another embodiment of cleaning mechanism having multiple wiper blades.

There are a wide variety of other embodiments of cleaning mechanisms that will not be described in great detail, each of these designs can result in increased cleaning characteristics by increasing the surface energy of the wiper blade relative to the surface tension of the ink and/or decreasing the surface energy of the orifice plate relative to the surface tension of the ink. One embodiment of the cleaning mechanism 500, as shown in FIG. 12, includes the wiper blade configured similar to a double-plated razor with a lubricated strip 1106. Another embodiment of cleaning mechanism, as shown in FIG. 13, includes the cleaning mechanism having two wiper blades as described relative to FIGS. 8, 9, and 10 (with two wiper blades separated by 6–8 mm), and having an additional third wiper blade 1202. The third wiper blade 1202 can be made of Teflon in one embodiment (surface energy of about 18 dynes/cm) that interfaces with ink (surface tension of about 35 dynes/cm) and the orifice plate 710 (surface energy of about 70 dynes/cm). In another embodiment as shown in FIG. 14, a tape or coating having a desired surface energy such as Kapton® tape or coating 1302 (Kapton is a trademark of the E.I. Nemours Dupont and Company for a polyimide film that is applicable to a variety of applications) is inserted on top of at lest a portion of the wiper blade to increase the surface energy of the wiper blade. In one embodiment, the surface energy of the tape or coating 1302 is from 45 to 59 dynes/cm, or more. Kapton has a surface energy of approximately 50 dynes/cm.

One benefit of the cleaning mechanism described herein is that the ink used in prior printers can therefore be maintained, while using different wiper blade materials and/or orifice plate materials to provide a more effective cleaning mechanism. It has been found that maintaining a 10 dynes/cm or greater separation between the surface tension of the ink with the surface energy of either the wiper blade of the orifice plate is satisfactory to provide suitable operation.

There are material choices, and also material/process choices, which can be used to get the orifice plate surface energy low (how smooth can you make the surface to reduce the effective surface energy down). Orifice plates can be designed with fluorinated surface, so the surface energy of the orifice plate is reduced. The surface tension of the ink is sufficiently high so that it wants to collect into droplets, and not make a puddle. If an ink puddle that forms on the orifice plate is in contact with the circumference of nozzle orifice, then as more ink comes out of the nozzle orifice, the ink drop can cause drop directionality problems for the exiting ink. With such directionality problems, the drops will be fired in a different direction than intended.

Figure 15:
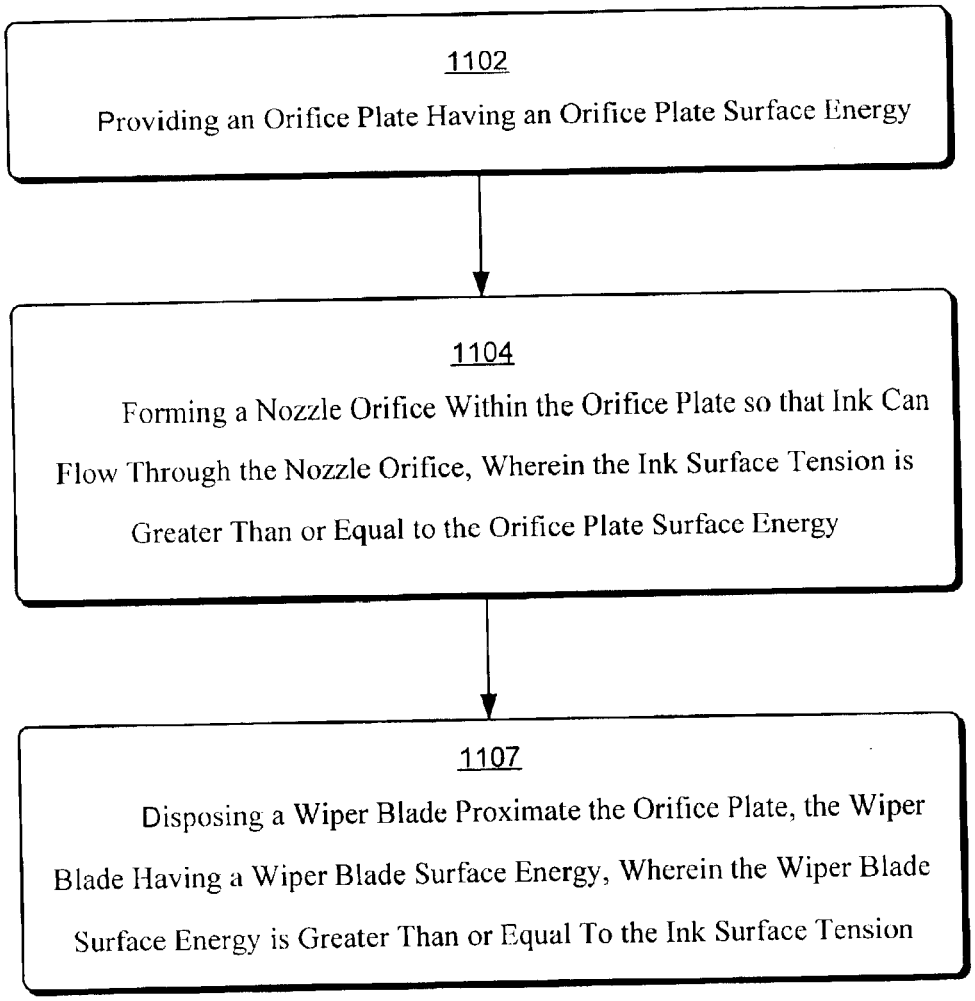
FIG. 15 shows a flow chart of using one embodiment of a cleaning mechanism.

FIG. 15 illustrates one embodiment of a method for cleaning the pen. An orifice plate having an orifice plate surface energy is provided in 1102. The nozzle orifice is formed within the orifice plate so that ink can flow through the nozzle orifice as shown in 1104. The ink has an ink surface tension. The wiper blade is positioned proximate the orifice plate in 1107 in such a manner that the wiper blade can be displaced relative to the orifice plate. The wiper blade has a wiper blade surface energy. According to certain aspects of the present disclosure, the wiper blade surface energy is greater than or equal to the ink surface tension. In other aspects of the present disclosure, the ink surface tension is greater than, or equal to the orifice plate surface energy.

CONCLUSION

Although the subject matter has been described in language specific to structural features and/or methodological operations, it is to be understood that the subject matter defined in the appended claims is not necessarily limited to the specific features or operations described. Thus, the specific features and operations are disclosed as preferred forms of implementing the claimed features.

What is claimed is:

1. A printer apparatus, comprising an orifice plate having a nozzle orifice formed therein wherein ink can flow through the nozzle orifice, the ink having an ink surface tension;

a wiper blade that can be displaced relative to the orifice plate to cause wiping of the orifice plate, the wiper having a wiper blade surface energy; and wherein the wiper blade surface energy is greater than or equal to the ink surface tension.

2. The printer apparatus as set forth in claim 1, wherein the wiper blade includes two wiper blades.

3. The printer apparatus as set forth in claim 2, wherein the two wiper blades are spaced by 6 to 8 mm.

4. The printer apparatus as set forth in claim 2, wherein each one of the two wiper blades includes a rounded surface that is formed on the opposed side of each wiper blade.

5. The printer apparatus as set forth in claim 2, wherein each one of the two wiper blades includes a squared-off surface that is formed on the side of each wiper blade that is facing the other one of the two wiper blades.

6. The printer apparatus as set forth in claim 1, wherein the wiper blade has a rounded surface, wherein the rounded surface and the orifice plate contribute to create a capillary channel.

7. The printer apparatus as set forth in claim 6, wherein the nozzle orifice contains ink, the ink having a meniscus, wherein the capillary channel enhances breaking the meniscus as the wiper blade is displaced to a position across the orifice plate.

8. The printer apparatus as set forth in claim 1, wherein the wiper blade has a squared-off surface that contributes with the orifice plate to create a squeegee action.

9. The printer apparatus as set forth in claim 1, wherein a portion of the orifice plate that has an orifice plate surface energy is located adjacent to an exposed surface of the orifice plate.

10. The printer apparatus as set forth in claim 9, wherein those portions of the orifice plate that is distant from the exposed surface of the orifice plate have a surface energy that increases wettability for ink compared to the orifice plate surface energy.

11. The printer apparatus as set forth in claim 1, wherein an orifice plate surface energy is sufficiently low to allow the ink to bead on the orifice plate.

12. The printer apparatus as set forth in claim 1, wherein the wiper blade surface energy is sufficiently high to attract ink based on wettability of the wiper blade.

13. The printer apparatus as set forth in claim 1, wherein a pen in the printer apparatus that includes the orifice plate is disposable.

14. The printer apparatus as set forth in claim 1, wherein a pen in the printer apparatus that includes the orifice plate is configured to last as long as the printer apparatus that the pen is contained within.

15. The printer apparatus as set forth in claim 1, wherein the pen is used during servicing events.

16. The printer apparatus as set forth in claim 1, wherein the wiper blade includes Teflon.

17. The printer apparatus as set forth in claim 1, wherein the wiper blade includes copper.

18. The printer apparatus as set forth in claim 1, wherein an orifice plate surface energy is reduced by coating a surface of the orifice plate.

19. The printer apparatus as set forth in claim 1, wherein an orifice plate surface energy is reduced by polishing a surface of the orifice plate.

20. A printer apparatus, comprising an orifice plate having a nozzle orifice formed therein wherein ink can flow through the nozzle orifice, the orifice plate having an orifice plate surface energy, the ink having an ink surface tension;

a wiper blade that can be disposed proximate the orifice plate, the wiper having a wiper blade surface energy; and wherein the wiper blade surface energy is greater than or equal to the ink surface tension, and wherein the ink surface tension is greater than or equal to the orifice plate surface energy.

21. The printer apparatus of claim 20, wherein the wiper blade includes a Kapton tape or coating, and wherein the wiper blade surface energy is provided by the Kapton tape or coating.

22. The printer apparatus of claim 20, wherein the wiper blade includes a lubricating strip.

23. A method for cleaning a pen in a printer, comprising providing an orifice plate having an orifice plate surface energy, wherein a nozzle orifice is formed within the orifice plate so that ink can flow through the nozzle orifice, wherein the ink has an ink surface tension;

disposing a wiper blade proximate the orifice plate that can be displaced relative to the orifice plate, the wiper blade having a wiper blade surface energy; and wherein the wiper blade surface energy is greater than or equal to the ink surface tension, and wherein the ink surface tension is greater than or equal to the orifice plate surface energy.

24. The method as set forth in claim 23, wherein the wiper includes two wiper blades.

25. The method as set forth in claim 24, further comprising fixedly separating the two wiper blades by 6 to 8 mm.

26. The method as set forth in claim 23, wherein the wiper blade has a rounded surface, wherein the rounded surface and the orifice plate contribute to create a capillary channel.

27. The method as set forth in claim 23, wherein the orifice nozzle contains ink having a meniscus, wherein the capillary channel enhances breaking the meniscus as the wiper blade is displaced across the orifice plate.

28. The method as set forth in claim 23, further comprising locating the portion of the orifice plate that has the orifice plate surface energy adjacent to an exposed surface of the orifice plate.

29. The method as set forth in claim 28, wherein those portions of the nozzle orifice that is distant from the exposed surface of the orifice plate have a surface energy that increases wettability for ink compared to the orifice plate surface energy.

30. The method as set forth in claim 23, wherein the orifice plate surface energy is sufficiently low to allow the ink to bead on the orifice plate.

31. The method as set forth in claim 23, further comprising attracting ink to the wiper blade based on the level of the wiper blade surface energy.

32. The method as set forth in claim 23, wherein the wiper blade includes Teflon.

33. The method as set forth in claim 23, wherein the wiper blade includes copper.

34. The method as set forth in claim 23, further comprising reducing the orifice plate surface energy by coating a surface of the orifice plate.

35. The method as set forth in claim 23, further comprising reducing the orifice plate surface energy by polishing a surface of the orifice plate.

36. A method for cleaning a pen in a printer, comprising creating an orifice plate having a nozzle orifice formed therein wherein ink can flow through the nozzle orifice, the ink having an ink surface tension;

disposing a wiper blade proximate the orifice plate that can be displaced relative to the orifice plate to cause wiping of the orifice plate, the wiper having a wiper blade surface energy; and wherein the wiper blade surface energy is greater than or equal to the ink surface tension.

* * * * *